US010328727B2

(12) United States Patent
Harigae

(10) Patent No.: US 10,328,727 B2
(45) Date of Patent: Jun. 25, 2019

(54) PRINTING APPARATUS, PRINTING SPEED CONTROL METHOD OF PRINTING APPARATUS, PRINTED PRODUCT OF PRINTING APPARATUS, AND PRINTED PRODUCT GENERATING METHOD OF PRINTED PRODUCT

(71) Applicant: SEIKO EPSON CORPORATION, Tokyo (JP)

(72) Inventor: Yusuke Harigae, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/534,991

(22) PCT Filed: Dec. 1, 2015

(86) PCT No.: PCT/JP2015/005975
§ 371 (c)(1),
(2) Date: Jun. 9, 2017

(87) PCT Pub. No.: WO2016/092777
PCT Pub. Date: Jun. 16, 2016

(65) Prior Publication Data

US 2017/0361630 A1 Dec. 21, 2017

(30) Foreign Application Priority Data

Dec. 10, 2014 (JP) ..... 2014-249641
Jul. 6, 2015 (JP) ..... 2015-135027

(51) Int. Cl.
*B41J 2/32* (2006.01)
*B41J 11/42* (2006.01)
*B41J 19/76* (2006.01)

(52) U.S. Cl.
CPC ..... *B41J 11/42* (2013.01); *B41J 2/32* (2013.01); *B41J 11/425* (2013.01); *B41J 19/76* (2013.01); *B41J 2202/21* (2013.01)

(58) Field of Classification Search
CPC ..... B41J 11/42; B41J 2/32; B41J 19/76
See application file for complete search history.

(56) References Cited

U.S. PATENT DOCUMENTS

2014/0009768 A1* 1/2014 Hegarty ..... B41J 2/3555 358/1.5
2016/0107459 A1 4/2016 Sato et al.

FOREIGN PATENT DOCUMENTS

JP 64-022573 A 1/1989
JP 01-216853 A 8/1989
(Continued)

OTHER PUBLICATIONS

International Search Report dated Jan. 26, 2016 in PCT/JP2015/005975 with English-language translation (4 pgs.).

*Primary Examiner* — Bradley W Thies
(74) *Attorney, Agent, or Firm* — Foley & Lardner LLP

(57) ABSTRACT

There is provided a printing apparatus of the present invention including: a printing portion which performs printing by a line type printing head; a transport portion which transports a printing medium along a transport path that faces the printing head; a region detection portion which analyzes printing data and detects a non-printing region which is a region that does not become a target of a printing operation; and a transport control portion which controls a transport speed when the non-printing region passes through the printing head to be higher than a transport speed when the other printing region passes through the printing head, in which the transport control portion performs an acceleration control at least at a part while the non-printing region passes
(Continued)

through the printing head and performs a constant speed control while the other printing region passes through the printing head.

11 Claims, 16 Drawing Sheets

(56) References Cited

FOREIGN PATENT DOCUMENTS

| | | | |
|---|---|---|---|
| JP | 08-183209 | A | 7/1996 |
| JP | 09-314933 | A | 12/1997 |
| JP | 2002-316448 | A | 10/2002 |
| JP | 4682019 | B2 | 5/2011 |
| JP | 2013-028090 | A | 2/2013 |
| JP | 2015-047826 | A | 3/2015 |

* cited by examiner

| TAPE WIDTH | SPEED V1 | N VALUE |
|---|---|---|
| 4 mm | 2 0 mm/sec | 7 |
| 6 mm | 2 0 mm/sec | 7 |
| 9 mm | 1 5 mm/sec | 5 |
| 1 2 mm | 1 5 mm/sec | 5 |
| 1 8 mm | 1 5 mm/sec | 5 |
| 2 4 mm | 1 0 mm/sec | 3 |

PRINTING APPARATUS, PRINTING SPEED CONTROL METHOD OF PRINTING APPARATUS, PRINTED PRODUCT OF PRINTING APPARATUS, AND PRINTED PRODUCT GENERATING METHOD OF PRINTED PRODUCT

CROSS REFERENCE TO RELATED APPLICATIONS

This application is a national stage entry of International Appl. No. PCT/JP2015/005975, filed on Dec. 1, 2015; which claims priority to Japanese Patent Application No. 2014-249641 filed on Dec. 10, 2014 and to Japanese Patent Application No. 2015-135027 filed on Jul. 6, 2015; the entire contents of all of which are incorporated by reference herein.

TECHNICAL FIELD

The present invention relates to a printing apparatus which can vary a printing speed, a printing speed control method of a printing apparatus, a printed product of a printing apparatus, and a printed product generating method of a printed product.

BACKGROUND ART

In the related art, as various technologies, the Patent Literatures described in the following are known. For example, in PTL 1, a technology of calculating dot density of one row of printing data that can be printed by a line type printing head and deciding a printing speed in accordance with the calculation result is disclosed. By the configuration, in PTL 1, a load applied to a driving power source portion that drives a printing head is constantly held.

Meanwhile, in PTL 2, a technology of controlling a printing speed of a non-printing area to be higher than a printing speed of a printing area is disclosed. By the configuration, in PTL 2, the printing time is shortened.

CITATION LIST

Patent Literature

PTL 1: Japanese Unexamined Patent Application Publication No. 1-216853

PTL 2: Japanese Unexamined Patent Application Publication No. 64-22573

SUMMARY OF INVENTION

Technical Problem

However, when the printing speed varies every one row as described in PTL1, there is a concern that a printing failure (irregularity of printed image or character blur) is caused since the speed is not stable. In addition, a technology of varying a transport speed of a printing medium for shortening the printing time as described in PTL 2 is known, but a configuration of decelerating when reaching the printing area eventually causes a printing failure.

Considering the above-described problems, an object of the present invention is to provide a printing apparatus and a printing speed control method of a printing apparatus which can shorten printing time while maintaining a printing quality.

Solution to Problem

A printing apparatus of the present invention is a printing apparatus which performs printing by moving at least one of a printing medium and a printing head relatively to the other one, including: a region detection portion which analyzes printing data and detects a non-printing region which is a region that does not become a target of a printing operation by the printing head; and a printing speed control portion which controls a printing speed when the non-printing region faces the printing head to be higher than a printing speed when the other printing region which is a region other than the non-printing region faces the printing head, in which the printing speed control portion performs an acceleration and deceleration control at least at a part while the non-printing region faces the printing head and performs a constant speed control while the other printing region faces the printing head.

A printing speed control method of a printing apparatus of the present invention is a printing speed control method of a printing apparatus that performs printing by moving at least one of a printing medium and a printing head relatively to the other one, the method including: a region detection step of analyzing printing data and detecting a non-printing region which is a region that does not become a target of a printing operation by the printing head; and a printing speed control step of controlling a printing speed when the non-printing region faces the printing head to be higher than a printing speed when the other printing region which is a region other than the non-printing region faces the printing head, in which the printing speed control step performs an acceleration and deceleration control at least at a part while the non-printing region faces the printing head and performs a constant speed control while the other printing region faces the printing head.

According to the configuration of the present invention, since the printing speed when the non-printing region faces the printing head is controlled to be higher than the printing speed when the other printing region other than the non-printing region faces the printing head, it is possible to shorten the printing time compared to a case where the printing is performed at a constant speed in the entire printing region. In addition, since the acceleration and deceleration control (speed-increase control) is performed at least at a part while the non-printing region faces the printing head and the constant speed control is performed while the other printing region faces the printing head, the printing quality is not damaged while shortening the printing time.

In addition, the printing speed control portion may control a moving speed of the printing head in a case where the printing head is moved relatively to the printing medium, or may control the transport speed of the printing medium in a case where the printing medium is moved relatively to the printing head. In addition, both of the moving speed of the printing head and the transport speed of the printing medium may be controlled.

In addition, the printing head may be any of a line type printing head and a serial type printing head.

In the printing apparatus of the present invention, a transport portion which transports the printing medium along a transport path that faces the printing head, is further provided, and the region detection portion detects one or more sections in a transport direction of the printing medium as the non-printing region, and the printing speed control portion is a transport control portion that controls a transport speed by the transport portion.

The configuration of the present invention can be employed in the printing apparatus that performs the printing while transporting the printing medium with respect to the printing head. In addition, according to the configuration of the present invention, since one or more sections in the transport direction of the printing medium are detected as the non-printing region, compared to a case where the non-printing region is detected two-dimensionally, the detection processing is easy.

In the printing apparatus of the present invention, the printing head is a line type printing head, and the region detection portion distinguishes whether or not each piece of unit printing data obtained by dividing the printing data by each of plural lines of data is printing target data including printing dot data or non-printing data that does not include the printing dot data, respectively, and detects a processing target region of a predetermined number of pieces of continuous non-printing data as the non-printing region in a case where the predetermined number or more of pieces of continuous non-printing data exist.

According to the configuration of the present invention, since the non-printing region is detected by simple processing of distinguishing whether or not the predetermined number or more of pieces of continuous unit printing data that does not include the printing dot data exist, the detection processing is easy. In addition, since it is distinguished whether or not the unit printing data is the non-printing data using not one line of data but for plural lines of data as the unit printing data, the distinguishing processing can be performed fast.

In the printing apparatus of the present invention, the region detection portion detects the non-printing region in a case where N (here, N is an integer that satisfies $N \geq 3$) or more pieces of continuous non-printing data exist, and the transport control portion performs an acceleration control while the first partial non-printing region passes through the printing head, and performs a deceleration control while the (M−1)-th and/or M-th partial non-printing region passes through the printing head, among M partial non-printing regions which are processing target regions of M pieces (here, M is an integer that satisfies $M \geq N$) of non-printing data that configure the non-printing region.

According to the configuration of the present invention, since the constant speed control is performed while at least the second to the (M−2)-th partial non-printing region passes through the printing head, by setting the transport speed during this to be the highest speed, an effect of shortening the printing time can be further improved.

In the printing apparatus of the present invention, the transport control portion performs the deceleration control while the processing target region of the final unit printing data passes through the printing head in a case where the final unit printing data is the non-printing data among the plural pieces of unit printing data obtained by dividing the printing data.

According to the configuration of the present invention, in a case where the final unit printing data is non-printing data, since the deceleration control is performed while the processing target region of the non-printing data passes through the printing head, it is not necessary to provide a deceleration section (rear blank) on the rear end side of the printing medium. In other words, in a case where the final unit printing data is the non-printing data, it is possible to reduce an amount of consumption of the printing medium only as much as the rear blank.

In the printing apparatus of the present invention, the transport control portion performs the acceleration control before the processing target region of the printing data passes through the printing head.

According to the configuration of the present invention, since the acceleration control is performed before the processing of the printing data, that is, in the transport section of a front blank, the transport control can be securely performed regardless of the contents of the printing data.

In the printing apparatus of the present invention, a width detection portion which detects a width in a direction orthogonal to the transport direction of the printing medium; and an initial setting portion which sets the N value in accordance with the detection result of the width detection portion, may further be provided.

The configuration of the present invention is appropriate for the printing apparatus that varies the printing speed in accordance with the printing width of the printing medium. In addition, by setting the N value in accordance with the printing speed of each printing width, it is possible to obtain a constant effect of shortening the printing time regardless of the printing width of the printing medium.

In the printing apparatus of the present invention, a printing portion which prints the printing target data in the other printing region of the printing medium, is further provided, and the transport portion transports the printing medium including the other printing region and the non-printing region.

According to the configuration of the present invention, it is possible to create the printing medium including the other printing region in which the printing target data is printed and the non-printing region.

A printed product of the present invention is the printing medium including the other printing region in which the printing target data is printed by the printing portion and the non-printing region transported by the transport portion.

According to the configuration of the present invention, it is possible to provide the printing medium including the other printing region in which the printing target data is printed and the non-printing region as the printed product.

A printed product generating method of the present invention includes: selecting the printing target data to be printed on the printing medium; designating the position at which the printing target data is disposed on the printing medium and the size of the printing target data; designating the non-printing region on the printing medium; and transporting the printing medium by printing the printing target data on the printing medium.

According to the configuration of the present invention, it is possible to select and dispose the printing target data in the printing medium, and to generate the printed product by designating the non-printing region on the printing medium. In other words, it is possible to generate the printed product by designating the printing target data and the non-printing region with respect to the printing medium which is not processed.

DESCRIPTION OF EMBODIMENTS

Figure 1:
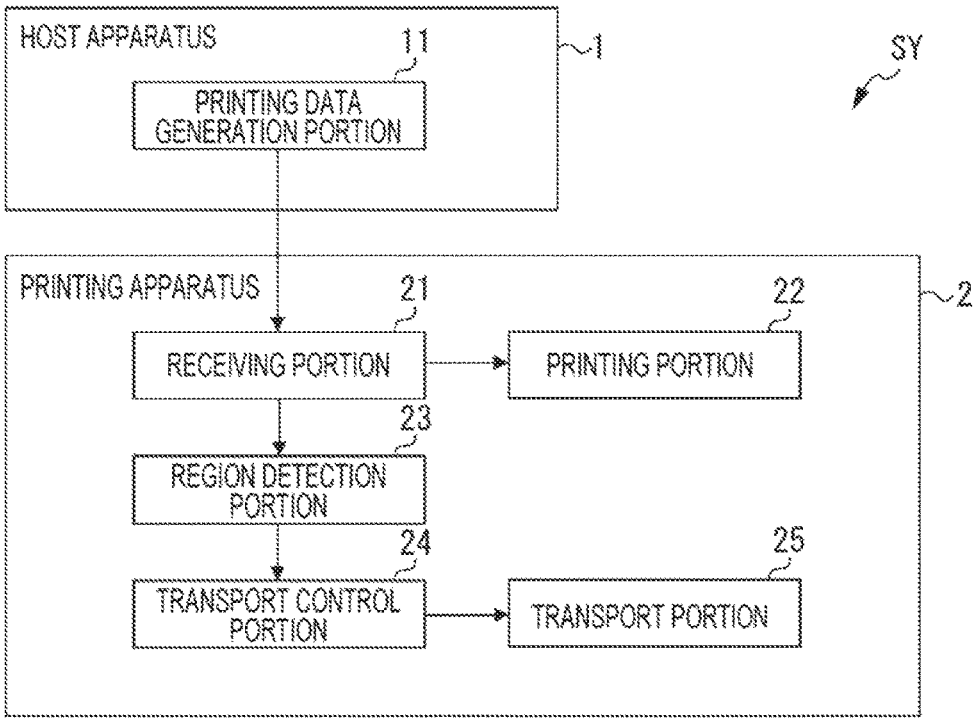
FIG. 1 is a block diagram illustrating a functional configuration of a printing system according to one embodiment of the present invention.

Hereinafter, a printing apparatus and a printing speed control method of a printing apparatus of the present invention will be described in detail with reference to the attached drawings. FIG. 1 is a block diagram illustrating a functional configuration of a printing system SY according to one embodiment of the present invention. The printing system SY includes a host apparatus 1 which generates printing data, and a printing apparatus 2 which performs printing based on the printing data received from the host apparatus 1. In addition, the host apparatus 1 and the printing apparatus 2 are connected to each other via wired communication or wireless communication. In addition, the connected state may be one-to-one connection or may be network connection.

The host apparatus 1 includes a printing data generation portion 11 as a main function. The printing data generation portion 11 generates printing data for performing label printing, and includes a label creating application which is not illustrated, an operating system (OS), a central processing unit (CPU), a display portion, and an operation portion as main portions. In addition, as the host apparatus 1, a personal computer, a personal digital assistants (PDA), a mobile phone, or various tables terminals (including a smart phone), is used. In addition, a processing flow of the label creating application will be described in detail as a printed product generating method.

Meanwhile, the printing apparatus 2 is a label printer that performs the printing on a tape-like printing medium (hereinafter, referred to as "printing tape T", refer to FIG. 2), and includes a receiving portion 21, a printing portion 22, a region detection portion 23, a transport control portion 24 (printing speed control portion), and a transport portion 25 as main functions. The printing tape T has a three-layer structure including a printing layer, an adhesive layer, and a peeling layer, and adheres the adhesive layer to an adhesion target by peeling the peeling layer when being used as a label. In addition, regardless of strength of an adhesive force or the presence or absence of the adhesive layer, the printing tape T may be a tape which is easily attachable and detachable having a relatively small adhesive force, a long paper tape or aluminum tape that does not include an adhesive layer or the like, or a ribbon which is used in packing. In addition, a material of the printing tape T is not particularly limited to a synthesized resin, paper, cloth, and metal foil, such as aluminum, and a material may be employed as long as the material is a material on which the printing is possible by the printing portion 22 which will be described later on one surface or on both surfaces of the printing tape T.

The receiving portion 21 receives the printing data and the control data from the host apparatus 1. In the embodiment, as the control data, tape length information indicating a length of the created label is received. In addition, the printing data or the control data may be described in a printing command that corresponds to the printing apparatus 2, or may be described in a general-purpose language, such as a markup language.

The printing portion 22 performs the printing based on the printing data output from the receiving portion 21. In the embodiment, the printing is performed by a thermal transfer method by a line type printing head (hereinafter, simply referred to as "printing head 45", refer to FIG. 2).

The region detection portion 23 analyzes the printing data output from the receiving portion 21, and detects a non-printing region which is a region that does not become a target of a printing operation by the printing head 45. In the embodiment, since the line type printing head is used, one or more sections in the transport direction of the printing tape T are detected as the non-printing region. Although will be described later, it is distinguished whether one or more pieces of unit printing data obtained by dividing the printing data by each of plural lines of data are printing target data including printing dot data or non-printing data that does not include the printing dot data, respectively, and in a case where N (here, N is an integer that satisfies $N \geq 3$) pieces of continuous non-printing data exist, a processing target region of the continuous non-printing data is detected as the non-printing region.

Figure 2:
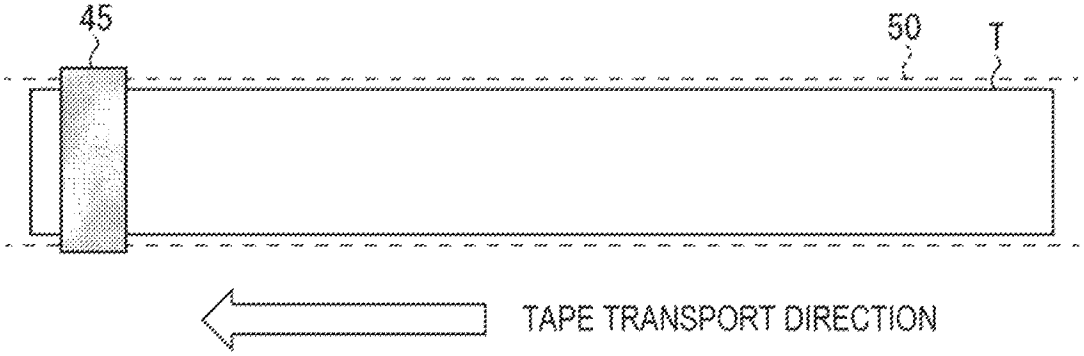
FIG. 2 is a view illustrating a transport direction with respect to a printing head of a printing tape.

The transport portion 25 transports the printing tape T which is the printing medium along a transport path 50. FIG. 2 is a view illustrating the transport direction of the printing tape T with respect to the printing head 45. As illustrated in FIG. 2, the printing head 45 which is fixedly provided faces the transport path 50, and the transport portion 25 transports the printing tape T in one direction (a direction orthogonal to a line direction of a heating body formed in a line shape in the printing head 45, leftward direction which is not illustrated) with respect to the printing head 45.

The transport control portion 24 controls a transport speed (printing speed) of the transport portion 25. For example, the transport speed when the non-printing region detected by the region detection portion 23 passes through the printing head 45 is controlled to be higher than the transport speed when the other printing region that is a region other than the non-printing region passes through the printing head 45. However, when accelerating and decelerating during the printing (during an operation of the printing head 45), there is a concern that a printing quality is damaged, and thus, a control to perform the acceleration and deceleration during non-printing is performed. In other words, the acceleration and deceleration control is performed while the non-printing region passes through the printing head 45, and a constant speed control is performed while the other printing region passes through the printing head 45. This will be described in detail later.

In addition, "acceleration and deceleration control" indicates a control (speed-increase control) for performing acceleration and/or deceleration. In addition, the "acceleration and deceleration control" is not necessarily always performed while the non-printing region passes through the printing head 45, and may be performed at least at a part while the non-printing region passes through the printing head 45.

Figure 3:
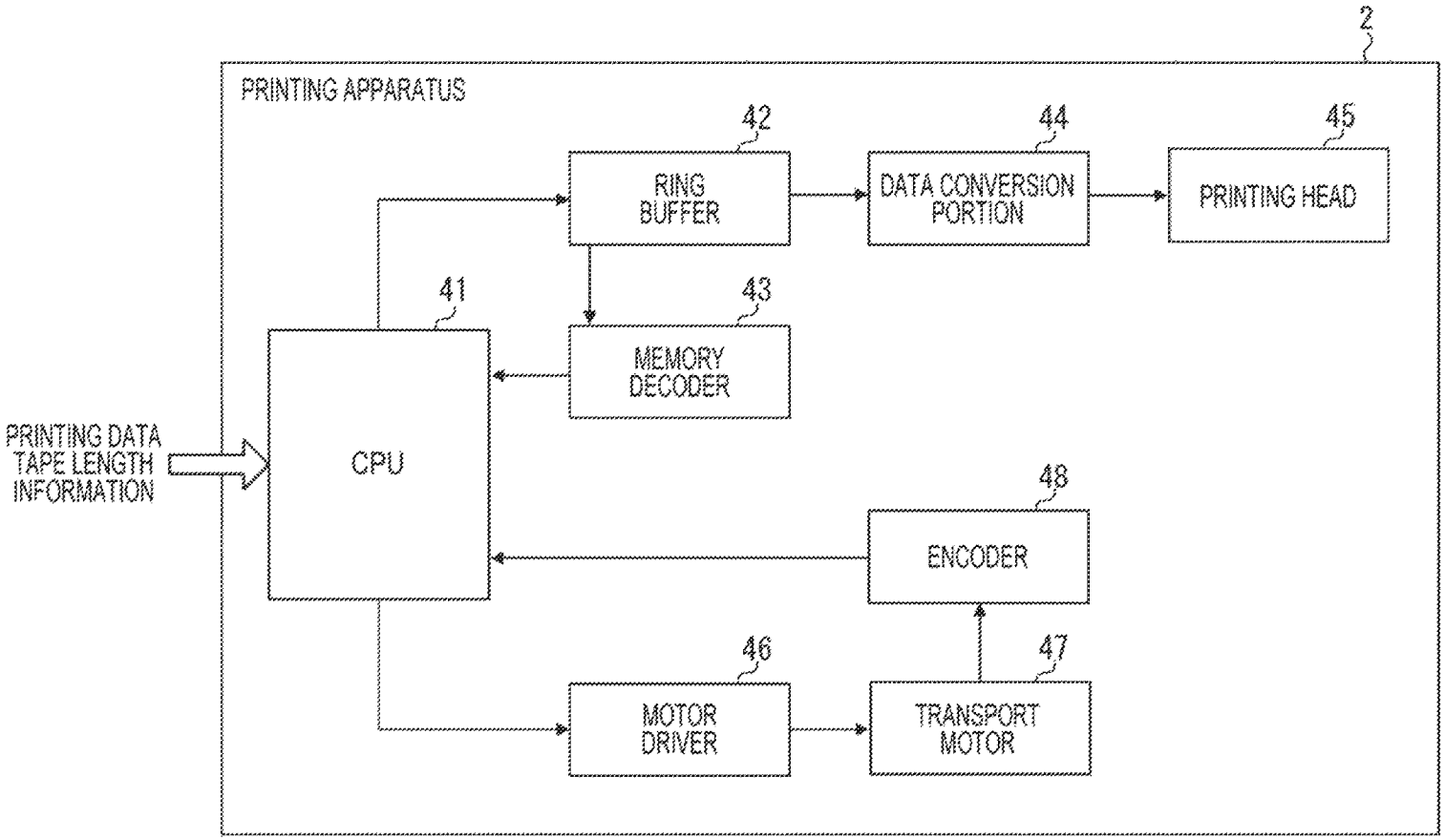
FIG. 3 is a block diagram illustrating a control system of a printing apparatus.

Next, with reference to FIG. 3, a control system of the printing apparatus 2 will be described. The printing apparatus 2 includes a ring buffer 42, a data conversion portion 44, and the printing head 45, as a configuration of the printing portion 22. In addition, a motor driver 46, a transport motor 47, and an encoder 48 are provided as a configuration of the transport portion 25. In addition, a CPU 41 and a memory decoder 43 are provided as a configuration of the region detection portion 23. Furthermore, the CPU 41 also functions as the transport control portion 24.

Figure 4:
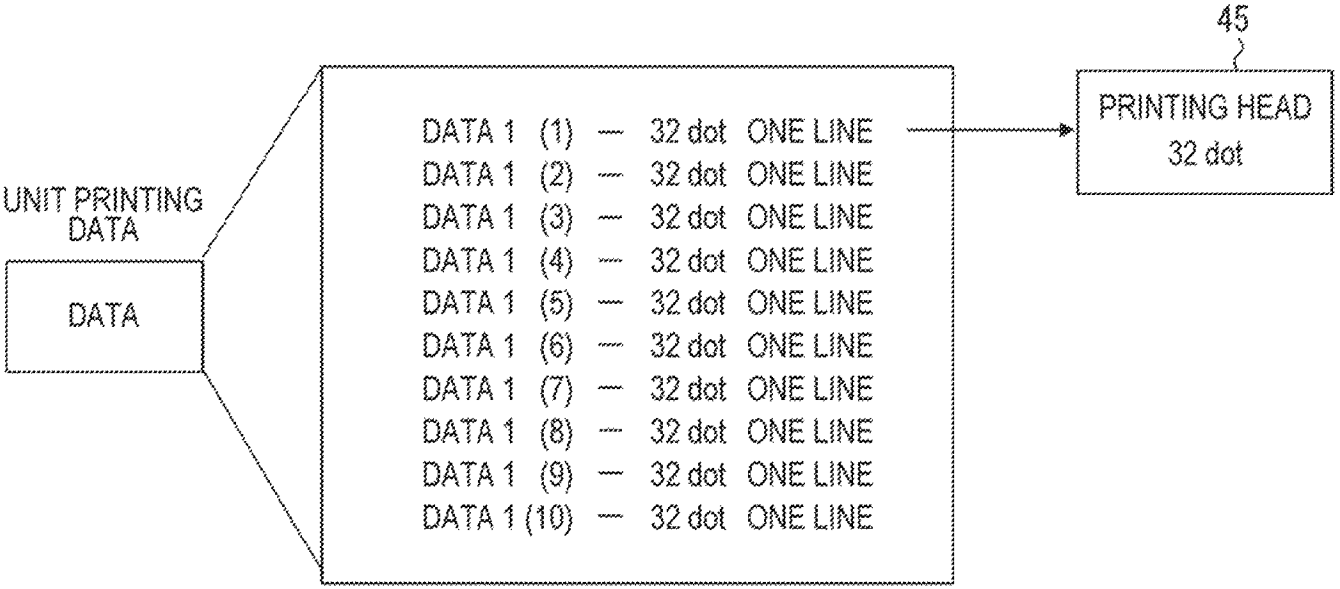
FIG. 4 is a view illustrating a configuration of unit printing data.

When obtaining the printing data and the tape length information from the host apparatus 1, the CPU 41 generates one or more pieces of unit printing data by dividing the printing data. FIG. 4 is a view illustrating a configuration of the unit printing data. As illustrated in FIG. 4, in the embodiment, one line of printing head 45 is configured of 32 dots, and 10 lines of data are included in one piece of unit printing data. The CPU 41 transfers the generated unit printing data to the ring buffer 42. The data conversion portion 44 performs data conversion for each line (32 dots) by reading out the unit printing data from the ring buffer 42, and supplies the data after the conversion to the printing head 45.

Figure 5:
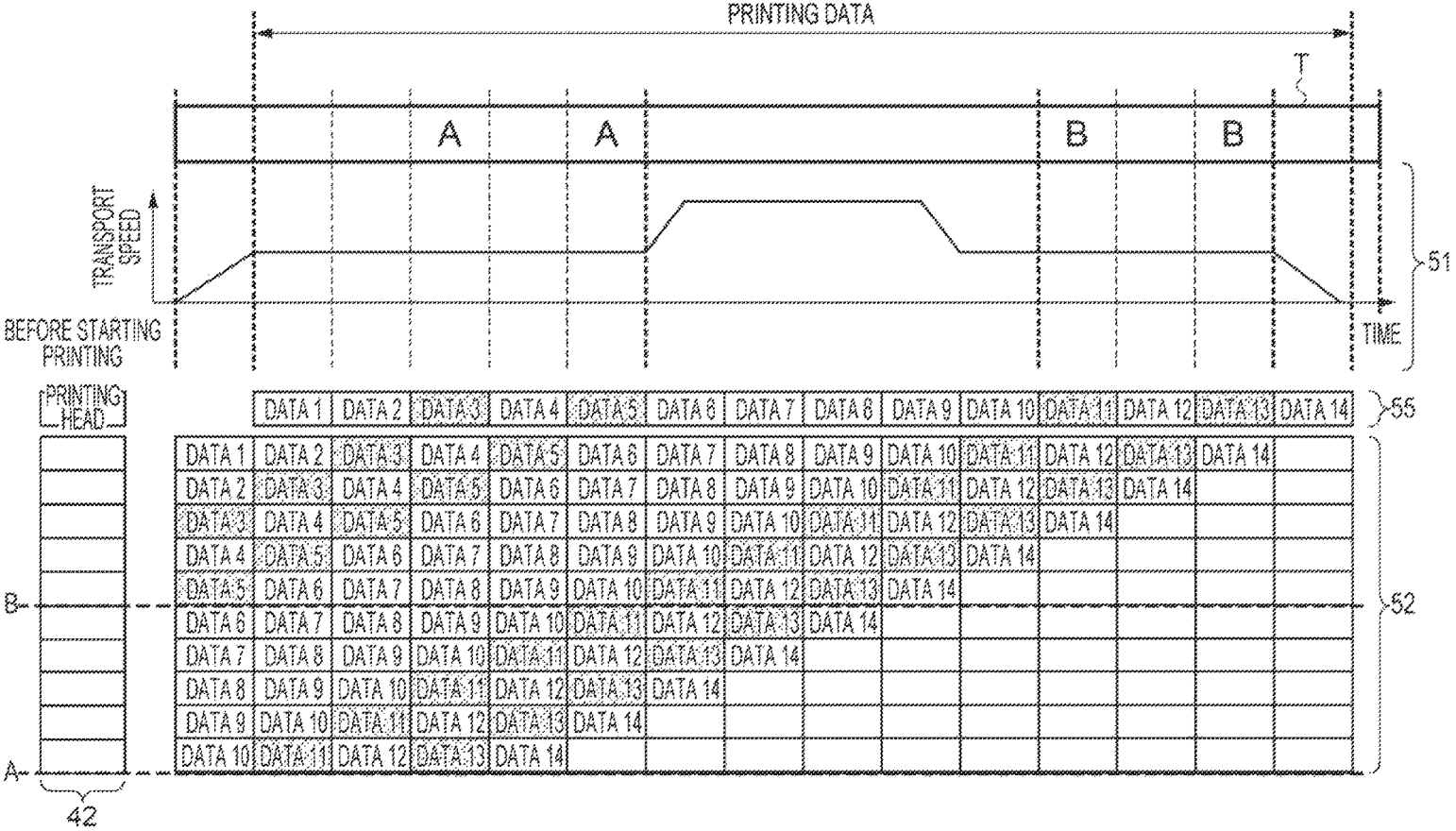
FIG. 5 is a view illustrating correspondence of a graph illustrating a transport speed of the printing tape and a storage table illustrating a data storage state of a ring buffer.

The memory decoder 43 monitors the ring buffer 42, and notifies the CPU 41 of the monitoring result. As illustrated in FIG. 5, the ring buffer 42 of the embodiment can store 10 pieces of unit printing data therein, moves a storage position of the unit printing data in order of the second storage position, the third storage position and so on from the first storage portion (point A), and finally supplies the data to the printing head 45. The memory decoder 43 notifies the CPU 41 of the data information (information indicating whether each piece of unit printing data is the printing target data including the printing dot data or the non-printing data that does not include the printing dot data) from the point A indicating the first storage portion to a point B indicating the fifth storage position. In addition, the point B is the fifth storage position since the region detection portion 23 detects the non-printing region in a case where the unit printing data is distinguished as five (N) or more continuous pieces of non-printing data.

Meanwhile, the CPU 41 controls the motor driver 46 and drives the transport motor 47 which is a DC motor. For example, while the transport motor 47 is driven (while the DC motor rotates), a PWM feedback control is performed by counting an output pulse of the encoder 48 for stabilizing the transport speed. In addition, when the transport motor 47 is stopped, variation in constant length caused by inertia rotation is suppressed, and thus, a brake control is performed.

Figure 6:
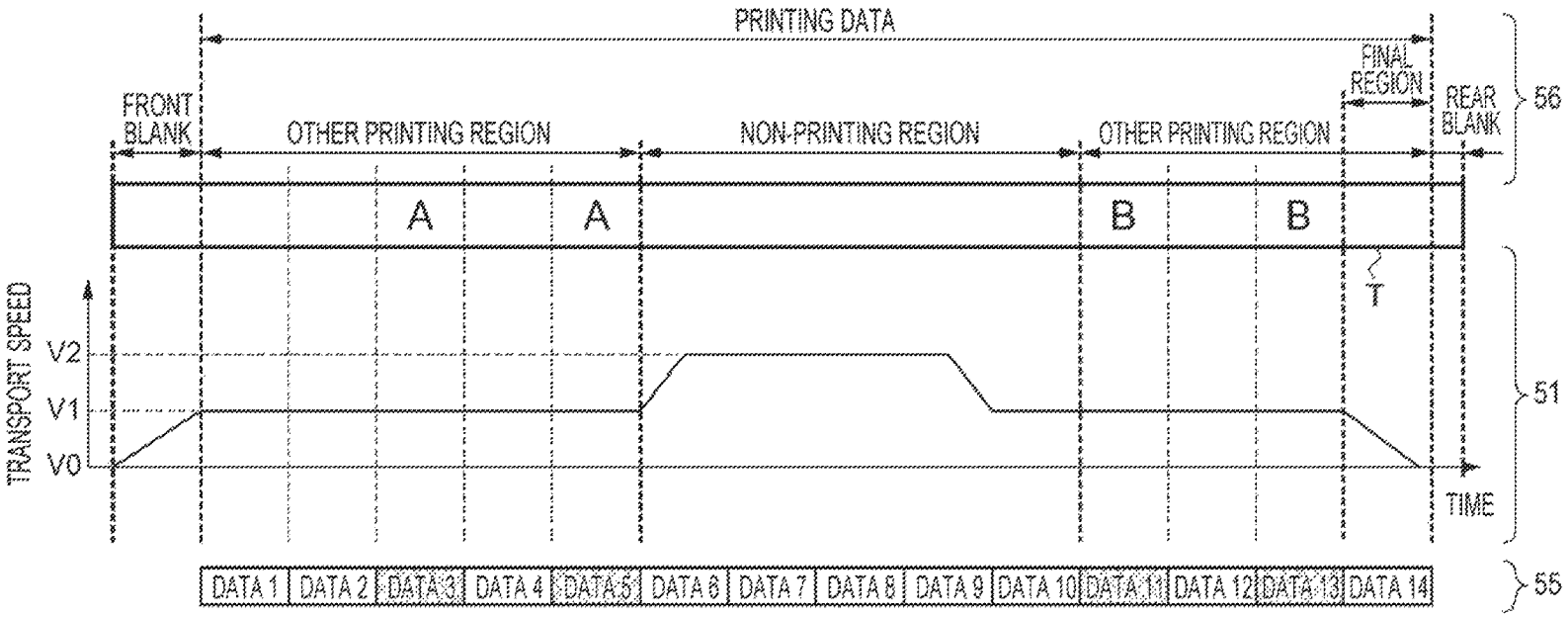
FIG. 6 is a specific view of a graph illustrating the transport speed of the printing tape.

Next, a specific example of the transport control of the printing tape T will be described with reference to FIGS. 5 and 6. FIG. 5 is a view illustrating correspondence of a graph (refer to numeral reference 51) illustrating a transport speed of the printing tape T and a storage table (refer to numeral reference 52) illustrating a data storage state of the ring buffer 42.

In the graph of the numeral reference 51 and a printing example of the printing tape T, a vertical dot line indicates separation of each piece of unit printing data. In addition, a numeral reference 55 indicates that the numbers are attached to each piece of unit printing data and timing at which each piece of unit printing data is transferred to the printing head 45. In addition, the printing example of the printing tape T indicates a processing target region of each piece of unit printing data in accordance with (to be in the same row) a transfer timing of each piece of unit printing data illustrated by the numeral reference 55. Furthermore, in the graph of the numeral reference 51, a horizontal axis indicates time and a vertical axis indicates a transport speed, and the processing target region of each piece of unit printing data indicates the transport speed when passing through the printing head 45.

Meanwhile, the storage table of the numeral reference 52 indicates a storage state of the ring buffer 42 in accordance with the processing timing (timing when each processing target region passes through the printing head 45) of each processing target region that indicates the printing example of the printing tape T. In addition, a hatched frame in the storage table indicates the unit printing data distinguished as the printing target data by the region detection portion 23, and a white frame indicates the unit printing data distinguished as the non-printing data by the region detection portion 23. For example, at the time before printing the printing data (the leftmost row of the storage table illustrated by the numeral reference 52), unit printing data of "data 1" to "data 11" is stored in the ring buffer 42, and at the processing timing (the second row from the left of the storage table illustrated by the numeral reference 52) of the "data 1" which is the initial unit printing data, the unit printing data of the "data 2" to the "data 10" is stored in the ring buffer 42. In addition, the CPU 41 grasps the number of pieces of unit printing data based on the tape length information obtained together with the printing data, and "data 14" becomes the final unit printing data in the example of FIG. 5.

Next, the processing target region of the printing tape T and the graph of the numeral reference 51 will be further described with reference to FIG. 6. As described above, the CPU 41 (region detection portion 23) detects the processing target region of five or more pieces of continuous non-printing data as the "non-printing region". Therefore, in the example of FIG. 6, as illustrated by a numeral reference 56, the processing target region of the "data 6" to the "data 10" of the unit printing data illustrated by the numeral reference 55 is detected as the "non-printing region". In addition, in the processing target region of the printing data, the region other than the non-printing region becomes the "other printing region".

In addition, for convenience, the processing target region of the final unit printing data of the processing target region of the printing data (processing target region of the "data 14" in the example of FIG. 6) is referred to as a "final region".

In addition, M (here, M is an integer that satisfies M≥N) processing target regions (the "data 6" to the "data 10" in the example of FIG. 6) that configure the "non-printing region" are referred to as "M partial non-printing regions".

Meanwhile, as illustrated in the graph of the numeral reference 51, the CPU 41 (transport control portion 24) accelerates the transport speed from V0 (speed "0") to a speed V1 (speed necessary for printing) before starting the processing of the printing data (in the middle of transport of front blank). In addition, in the middle of processing of the "other printing region", the constant speed control of the speed V1 is performed. Furthermore, the acceleration control of accelerating the speed to a speed V2 (here, V1<V2) is performed in the middle of processing of the first partial non-printing region (the "data 6" in the example of FIG. 6) in the "non-printing region", and the deceleration control of decelerating the speed to the speed V1 is performed in the middle of the processing of the (M−1)-th partial non-printing region (the "data 9" in the example of FIG. 6). In addition, the deceleration control may be performed in the middle of processing of the M-th partial non-printing region (the "data 10" in the example of FIG. 6), or may be performed in the middle of the processing of the (M−1)-th to the M-th partial non-printing region. In addition, since the final unit printing data is the non-printing data in the example of FIG. 6, the CPU 41 performs the deceleration control of decelerating the speed to the speed V0 in the middle of processing of "final region" which is the processing target region of the final unit printing data. In addition, in a case where the final unit printing data is the printing target data, the deceleration control is performed after finishing the processing of the printing data (in the middle of transport of the rear blank).

In addition, the printing apparatus 2 of the embodiment creates the label attached to the above-described "front blank" and the "rear blank", to the printing data sent from the host apparatus 1. However, it is not necessary to add the blanks, and the attaching of the "front blank" and/or the "rear blank" may be omitted in accordance with the specification of the printing apparatus 2 or the command from the host apparatus 1.

Next, a flow of the printing processing by the printing apparatus 2 will be described with reference to flowcharts in FIGS. 7 and 8. In addition, in the flowchart, a control of accelerating the transport speed from V0 to V1 (transport control of the front blank) and a control of decelerating the transport speed from V1 to V0 (transport of the final region and the rear blank) are not described. In addition, the flow illustrated in the flowchart corresponds to the printing speed control method. In addition, steps S05, S06, and S07 illustrated in the following correspond to a region detection step, and steps S09, S10, S12, and S13 correspond to a printing speed control step.

When starting the transport of the printing tape T by receiving the printing data and the tape length information from the host apparatus 1, the printing apparatus 2 (CPU 41) checks the data (unit printing data) of the point A of the ring buffer 42 (step S01, refer to FIG. 5), and distinguishes whether the data of the point A is the printing target data or the non-printing data (step S02). For example, in the example of FIG. 5, since the data of the point A in the ring buffer 42 immediately after starting the printing processing is the "data 10", it is distinguished that the data of the point A is the non-printing data in step S02.

In step S02, in a case where it is distinguished that the data of the point A is the printing target data, the process moves to step S03. In addition, in step S02, the distinguishing of the printing length is also performed based on the tape length information, and in a case where the printing length is less than a predetermined threshold value L1, the process also moves to step S03. Here, the predetermined threshold value L1 may be calculated as "length (length for N×10 lines)+α in the tape length direction that can be printed by N pieces of unit printing data".

Meanwhile, in a case where it is distinguished that the data of the point A is the non-printing data in step S02, the printing apparatus 2 distinguishes whether or not the non-printing region setting is achieved (step S04). Regarding the non-printing region setting, the setting is performed in step S07 which will be described later. For example, since the non-printing region setting is not achieved immediately after starting the printing processing, "FALSE" is distinguished in step S04. In a case where "FALSE" is distinguished in step S04, then, it is distinguished whether or not the number of pieces of non-printing data is equal to or greater than 5 (step S05). For example, in the example of FIG. 5, since all pieces of data from the point A to the point B are non-printing data in the ring buffer 42 immediately after starting the printing processing, it is distinguished that the number of pieces of non-printing data is equal to greater than 5.

In a case where it is distinguished that the number of pieces of non-printing data is equal to or greater than 5 in step S05, the printing apparatus 2 sets "non-printing region count" to be "5" (step S06), and sets the non-printing region setting to be "TRUE" (step S07). In addition, "data sending count" is set to be "5" (step S08), and the process moves to step S03. In addition, the "non-printing region count" is for counting the length of the non-printing region, and is used for measuring the deceleration timing from the speed V2 to the speed V1 and for measuring the timing of returning the non-printing region setting to "FALSE". In addition, the "data sending count" is used for counting the sending amount to the non-printing region. In the embodiment, since the sending amount from the point B of the ring buffer 42 to the data supply to the printing head 45 becomes "5" (since the number of regions of the ring buffer 42 "10"−N value "5"=5), the "data sending count" is set to be "5" in step S08.

In step S03, it is distinguished whether or not the printing region setting is achieved. In a case where the printing region setting is "FALSE", the process moves to step S16 of FIG. 8. In addition, in a case where the printing region setting is "TRUE", it is distinguished whether or not the "data sending count" is "0", and in a case where the "data sending count" is not "0" (in a case where the "data sending count" is greater than "0"), the "data sending count" is decremented (step S09), and the process returns to step S01. In other words, the process moves to processing of the next unit printing data. In addition, in a case where the "data sending count" is "0", the acceleration setting for accelerating the speed from the speed V1 to the speed V2 is performed (changing the PWM setting, step S10), and the process moves to step S12 of FIG. 8.

Meanwhile, in a case where the printing apparatus 2 distinguishes that the non-printing region setting is "TRUE" in step S04, the "non-printing region count" is incremented (step S11), and the process moves to step S09. In other words, in a case where the non-printing region is configured of six or more pieces of non-printing data, the "non-printing region count" increases one by one in step S11.

Figure 7:
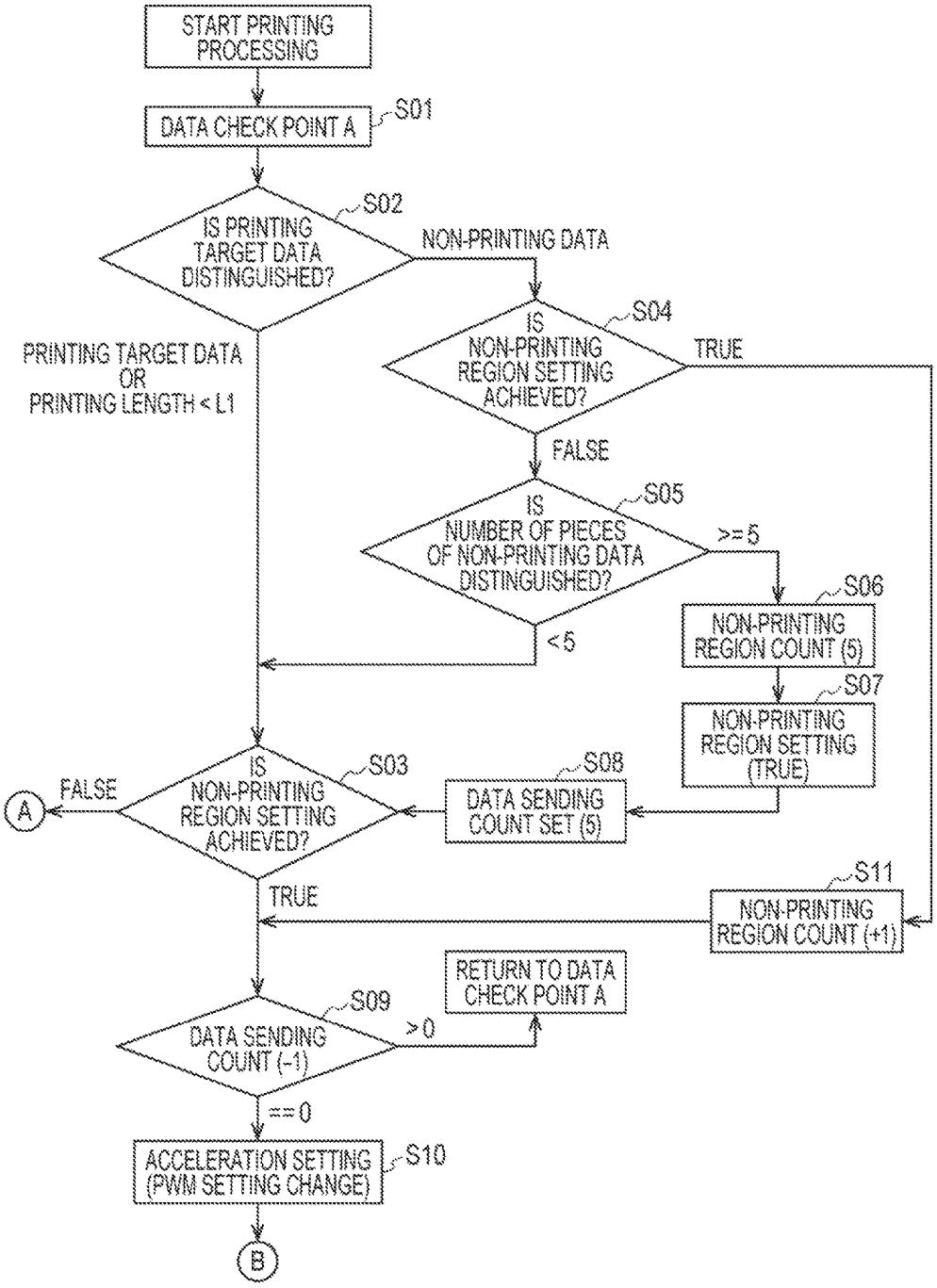
FIG. 7 is flowchart illustrating a first half of printing processing.
Figure 8:
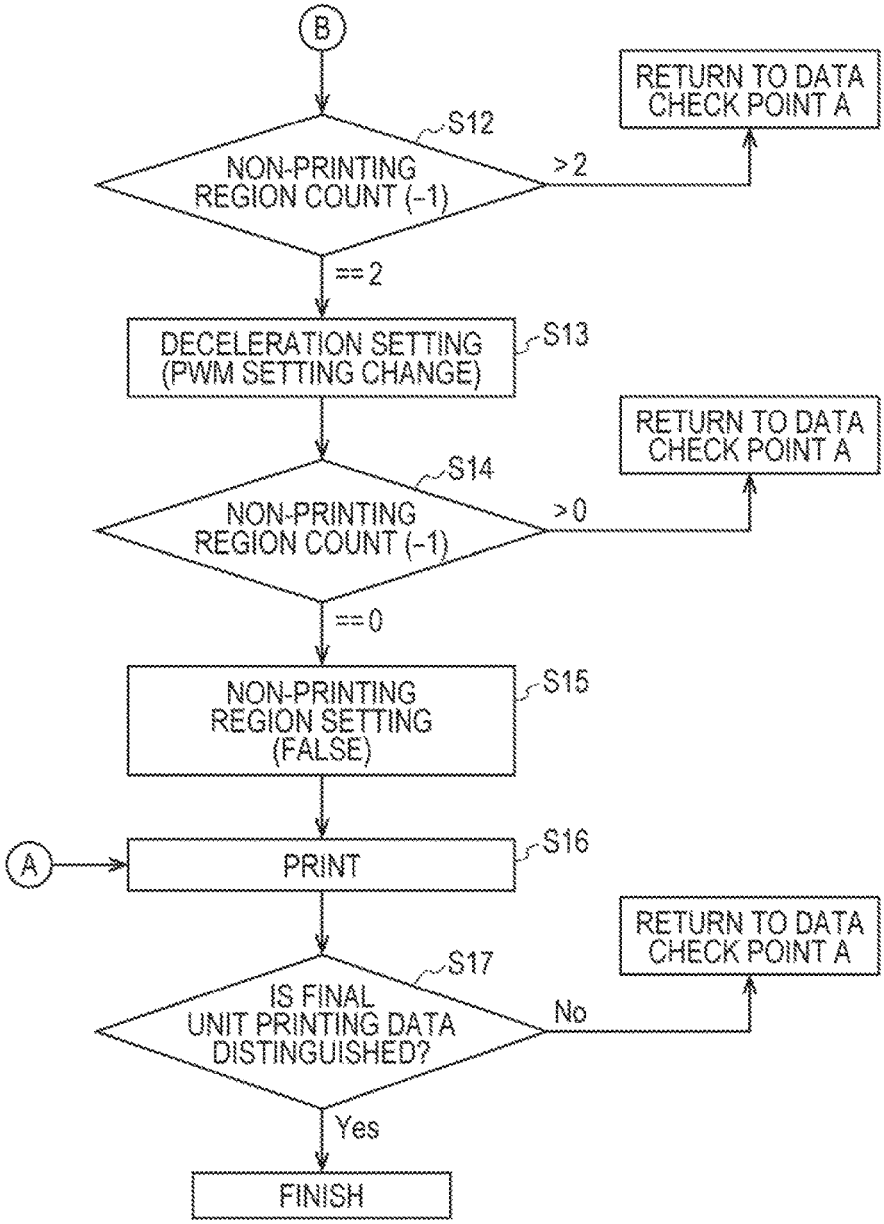
FIG. 8 is a flowchart illustrating a second half of the printing processing.

After performing the acceleration setting in step S10 of FIG. 7, as illustrated in FIG. 8, the printing apparatus 2 distinguishes whether or not the "non-printing region count" is "2" (step S12), and in a case where the "non-printing region count" is not "2" (in a case where the "non-printing region count" is greater than "2"), the "non-printing region count" is decremented and the process returns to step S01. In addition, in a case where the "non-printing region count" is "2", the deceleration setting for decelerating the speed from the speed V2 to the speed V1 is performed (changing the PWM setting, step S13). In addition, in step S12, it is distinguished whether or not the "non-printing region count" is "2" in order to perform the deceleration in the middle of the processing of the "data 9" (the second data from the final data), for example, in a case where the non-printing region is configured of the "data 6" to "data 10" (refer to FIG. 6).

After performing the deceleration setting in step S13, the printing apparatus 2 distinguishes whether or not the "non-printing region count" is "0" at this time (step S14), and in a case where the "non-printing region count" is not "0" (in a case where the "non-printing region count" is greater than "0"), the non-printing region count" is decremented and the process returns to step S01. In addition, in a case where the "non-printing region count" is "0", the non-printing region setting is set to be "FALSE" (step S15), and the printing is performed (step S16). In addition, the "printing" described here does not indicate forming of printing dots by the printing head 45, and means that the unit printing data supplied to the printing head 45 is processed. After step S16, it is distinguished whether or not the printing data is the final unit printing data (step S17), in a case where the printing data is not the final unit printing data (step S17: NO), the process returns to step S01. In addition, in a case where the printing data is the final unit printing data (step S17: YES), the printing processing is finished.

As described above, according to the embodiment, since the acceleration and deceleration control is performed in the middle of the processing of the non-printing region and the constant speed control is performed in the middle of processing of the other printing region, by varying the transport speed, damage of the printing quality, such as irregularity of printed image or character blur, is not caused. In addition, in the non-printing region configured of M partial non-printing regions, since the acceleration control is performed in the middle of the processing of the first partial non-printing region, and the deceleration control is performed in the middle of the processing of the second from the final or the final partial non-printing region, it is possible to perform the constant speed control in the middle of the processing of at least the second to the (M−2)-th partial non-printing region. In other words, by setting the transport speed to be the highest speed (speed V2 in the embodiment) during this, it is possible to further improve an effect of shortening the printing time.

Next, the printed product generated by realizing the above-described embodiment and the printed product generating method will be described.

Example 1

Figure 9:
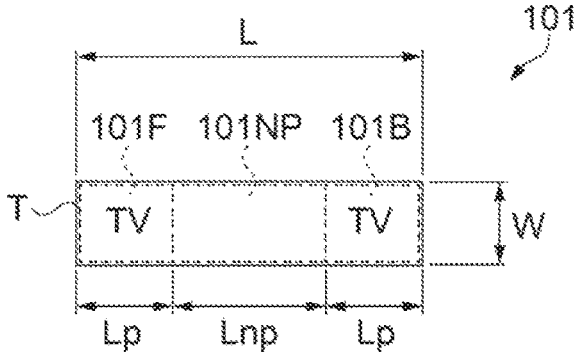
FIG. 9 is a view illustrating an image of a printed product according to Example 1.
Figure 10:
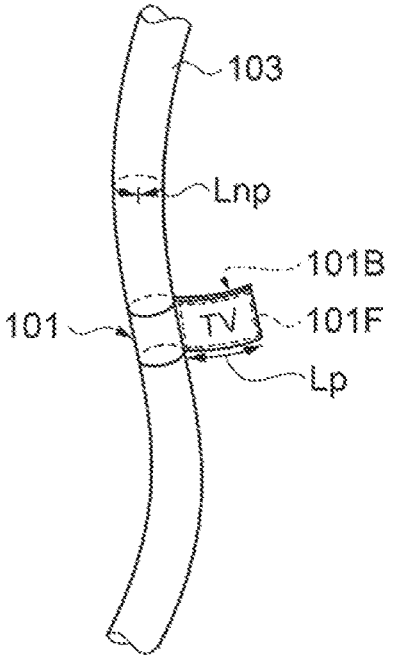
FIG. 10 is a view illustrating a use example of the printed product according to Example 1.

FIG. 9 is a view illustrating an image of a printed product according to Example 1. FIG. 10 is a view illustrating a use example of the printed product according to Example 1.

A label 101 is a label which sticks around a cable or the like, and is used for specifying the type or the like of the stuck cable. The label 101 is a printed product created by sending the printing data generated as the printing data generation portion 11 of the host apparatus 1 is realized to the printing apparatus 2, and by printing and transporting the printing data by the printing portion 22 of the printing apparatus 2 and the transport portion 25.

The label 101 is the printed product created by sending the printing data generated as the printing data generation portion 11 of the host apparatus 1 is realized to the printing apparatus 2, and by printing and transporting the printing data to the printing tape T by the printing portion 22 of the printing apparatus 2 and the transport portion 25 based on the printing data.

In the label 101, a character region 101F is disposed at one end of a printing surface (front surface) of the printing tape T, a character region 101B is disposed at the other end, and a winding region 101NP is disposed between the character region 101F and the character region 101B. A surface (rear surface) opposite to the printing surface of the printing tape T is the adhesive layer. The label 101 has the size of a tape width W and a length L, the character regions 101F and 101B commonly have the same length Lp, and the winding region 101NP has a length Lnp. In the character region 101F and the character region 101B, the same contents, that is, a character row "TV", are respectively printed. The winding region 101NP is a region in which nothing is printed.

As illustrated in FIG. 10, the label 101 is wound around and sticks to a TV cable 103 which is a high-frequency coaxial cable for television reception. The winding region 101NP sticks to an outer circumference of a trunk portion of the TV cable 103. Since the length Lnp is set in accordance with a peripheral length of the outer circumference of the trunk portion by the printing data generation portion 11, a part remaining after sticking to the outer circumference of the trunk portion becomes a part of the length Lp of the character regions 101F and 101B, and the adhesive layers of the rear surfaces stick to each other. The printing is performed in the character region 101F and the character region 101B on surfaces on both sides of the printing tape T of which the rear surfaces stick to each other.

Furthermore, the winding region 101NP corresponds to the non-printing region, and the character regions 101F and 101B correspond to the other printing regions. In addition, the character row "TV" corresponds to the printing target data.

Above, according to the embodiment, at a part of the winding region 101NP of the label 101, the winding around the TV cable 103 is a goal, and the printed information is not necessary. In contrast, in the character regions 101F and 101B, the printing of the character row "TV" is necessary as a tag-like mark. In the label 101, by employing the above-described embodiment, it is possible to transport the regions of the character regions 101F and 101B at the transport speed that can ensure the printing quality by the constant speed control, and to transport the region of the winding region 101NP at a high speed by increasing the transport speed to the highest speed. Therefore, it is possible to create the label 101 of which the printing time is more shortened than that of the related art and the printing quality is ensured at the printing part, as the printed product.

Example 2

Figure 11:
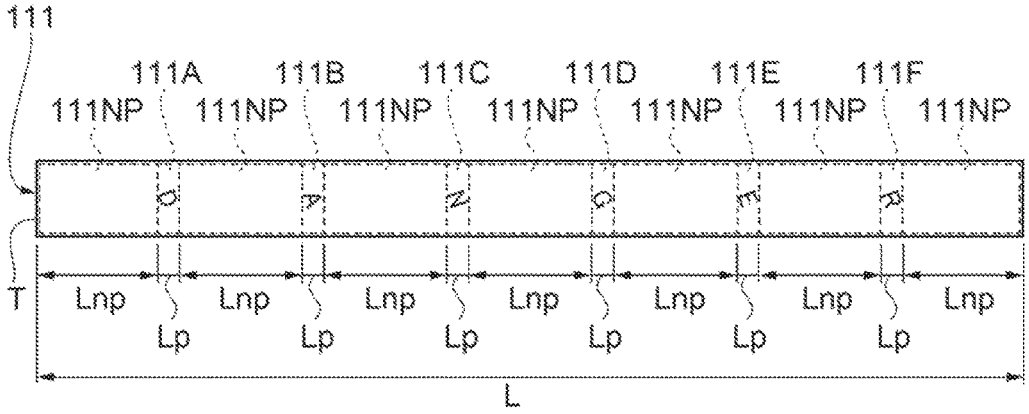
FIG. 11 is a view illustrating an image of a printed product according to Example 2.
Figure 12:
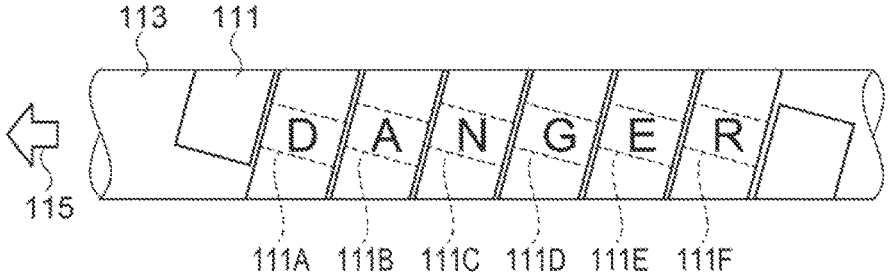
FIG. 12 is a view illustrating a use example of the printed product according to Example 2.

FIG. 11 is a view illustrating an image of a printed product according to Example 2. FIG. 12 is a view illustrating a use example of the printed product according to Example 2.

The label 111 is a label which can be wound around and stick by tube-like or rod-like equipment or tool, and specifies information related to the equipment or the tool in a wound state. The label 111 is appropriate for use for specifying information for making a warning or notice in pipes, such as a gas pipe or a water pipe, or information, such as a caution for use stuck to fitness equipment, such as a barbell or a dumbbell, a handle of a pickaxe used in a construction site, or a rod-like part, such as bar.

The label 111 is the printed product created by sending the printing data generated as the printing data generation portion 11 of the host apparatus 1 is realized to the printing apparatus 2, and by printing and transporting the printing data to the printing tape T by the printing portion 22 of the printing apparatus 2 and the transport portion 25 based on the printing data.

The label 111 includes character regions 111A to F and seven winding regions 111NP on the printing surface of the printing tape T having the length L. A surface opposite to the printing surface of the printing tape T is the adhesive layer. In the character regions 111A to F, each of characters "D", "A", "N", "G", "E", and "R" is printed making a predetermined angle. Each of the character regions 111A to F has the length Lp. The winding regions 111NP are positioned on both sides of the character regions 111A to F, and respectively have the length Lnp. The length Lnp is longer than the length Lp, and is at least three times or more the length.

As illustrated in FIG. 12, the label 111 is wound around and sticks to a gas pipe 113. In a state of sticking to the outer circumference of the gas pipe 113, the character regions 111A to F of the label 111 are disposed in parallel to a transport direction 115 of gas of the gas pipe 113, and the character row of "DANGER" is formed. The length Lnp is longer than the length Lp and depends on the length of the outer circumference of the gas pipe 113, and in the example, the length Lnp is at least three times or more the length Lp. In addition, a predetermined angle of the above-described characters depends on the angle when the label 111 is wound around the gas pipe 113. The length Lnp or the length Lp and the predetermined angle are decided as the printing data generation portion 11 of the host apparatus 1 is realized.

Furthermore, the winding region 111NP corresponds to the non-printing region, and the character regions 111A to F correspond to other printing regions. In addition, each of the characters "D", "A", "N", "G", "E", and "R" corresponds to the printing target data.

Above, according to the embodiment, in the label 111, since the entire label 111 is wound around and sticks to equipment or tool, a part that becomes obstructive in a case of using the equipment or tool is small. In addition, it is possible to increase the number of characters to be printed or the like by increasing the winding amount (increasing the length L). In the label 111, by employing the above-described embodiment, by raising the transport speed of the region of the label winding region 111NP to the highest speed, and by performing the constant speed control with respect to the character regions 111A to F, it is possible to further shorten the printing time compared to the related art, and to create the label 111 of which the printing quality is ensured at the printed part as the printed product.

Example 3

Figure 13:
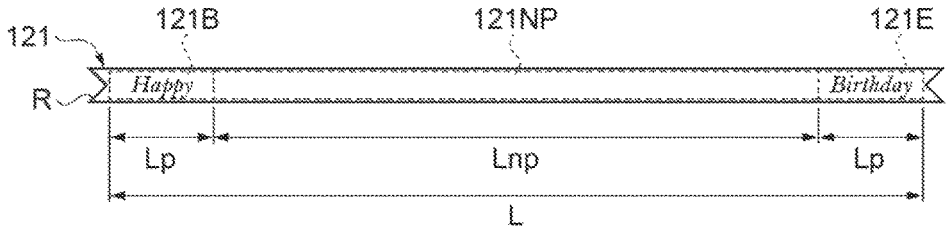
FIG. 13 is a view illustrating an image of a printed product according to Example 3.
Figure 14:
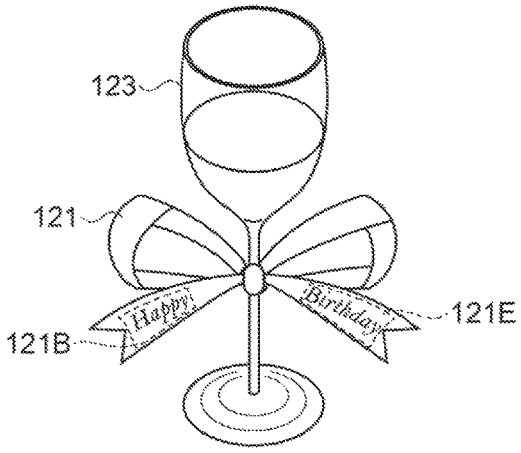
FIG. 14 is a view illustrating a use example of the printed product according to Example 3.
Figure 15:
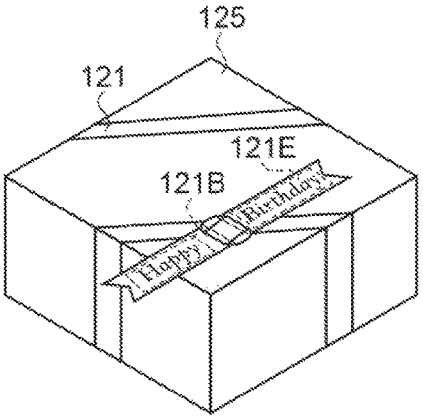
FIG. 15 is a view illustrating a use example of the printed product according to Example 3.

FIG. 13 is a view illustrating an image of the printed product according to Example 3. FIGS. 14 and 15 are views illustrating a use example of the printed product according to Example 3.

A ribbon 121 is a label printed on a ribbon tape R which is a tape-like printing medium. The ribbon tape R is one aspect of the printing tape T, a rear surface opposite to the printing surface (front surface) does not include the adhesive layer. The ribbon tape R is used in package or the like of a present or a gift as an appropriate example.

The ribbon 121 is a printed product created by sending the printing data generated as the printing data generation portion 11 of the host apparatus 1 is realized to the printing apparatus 2, and by printing and transporting the printing data to the ribbon tape R by the printing portion 22 of the printing apparatus 2 and the transport portion 25 based on the printing data.

The ribbon 121 includes a character regions 121B and 121E and a tying region 121NP on the printing surface of the ribbon tape R. The rear surface of the ribbon tape R may be configured of the character regions 121B and 121E and the tying region 121NP similar to the printing surface, or may have a configuration in which nothing is printed.

The character regions 121B and 121E are disposed at positions of each of a tip end and a final end of the ribbon 121, and "Happy" is printed in the character region 121B and "Birthday" is printed in the character region 121E. The tying region 121NP is disposed to extend between the character region 121B and the character region 121E which are disposed at both ends of the ribbon 121. The character regions 121B and 121E respectively have the length Lp, and the tying region 121NP has the length Lnp. Each of the lengths of the character region 121B and the character region 121E is described as the length Lp, but the lengths Lp may be the same length or may be different lengths.

The length Lnp of the tying region 121NP is the length by which at least N or more (N is an integer that satisfies $N \geq 3$) pieces of continuous unit printing data exist. For example, when the unit printing data has a length for one character, the tying region 121NP has a length (practically, the length having a corresponding amount for tying) for at least three or more characters.

In the use example illustrated in FIG. 14, the ribbon 121 is tied at a stem of a wine glass 123. At both ends of the ribbon 121 of which the part of the tying region 121NP of the ribbon 121 is tied by butterfly tying, the "Happy" and the "Birthday" are printed.

In the use example illustrated in FIG. 15, the ribbon 121 is used for wrapping a present 125. At both ends of the ribbon 121, the "Happy" and the "Birthday" are printed. The tying region 121NP integrally ties wrapping paper of the present 125.

Furthermore, the tying region 121NP corresponds to the non-printing region and the character regions 121B and 121E correspond to the other printing regions. In addition, the character rows "Happy" and the "Birthday" correspond to the printing target data.

Above, according to the example, the tying region 121NP of the ribbon 121 is a region which is used for tying the wine glass 123 or the present 125. In the wine glass 123, a message of "Happy Birthday" is efficiently delivered by providing the character region 121B and the character region 121E at a place which attracts attention, such as both ends exposed from the knot.

In the present 125, the character region 121B and the character region 121E are provided near the knot that opens the present 125. There is an effect of reliably delivering the message of "Happy Birthday" since the character region 121B and the character region 121E attract attention when opening the present 125.

In the ribbon 121, by employing the above-described embodiment, it is possible to transport the regions of the character regions 121B and 121E at the transport speed at which the printing quality can be ensured by performing the constant speed control, and to transport the regions of the tying region 121NP at a high speed by raising the transport speed to the highest speed. In particular, in the ribbon 121, since the length having the corresponding amount necessary for tying with respect to the tying region 121NP is required, the effect is high in transport at a high speed. Therefore, it is possible to further shorten the printing time compared to the related art, and to create the ribbon 121 of which the printing quality is ensured at the printing part as the printed product.

Example 4

Figure 16:
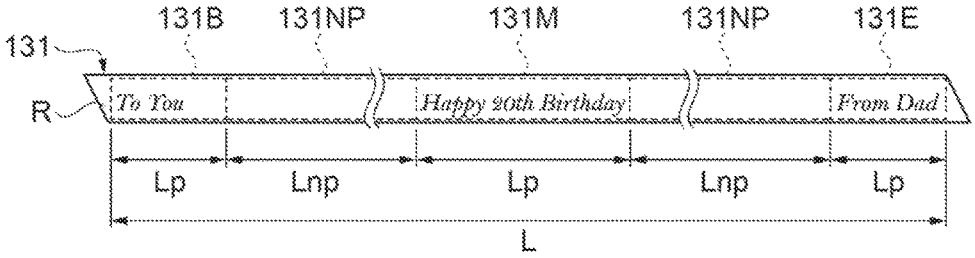
FIG. 16 is a view illustrating an image of a printed product according to Example 4.
Figure 17:
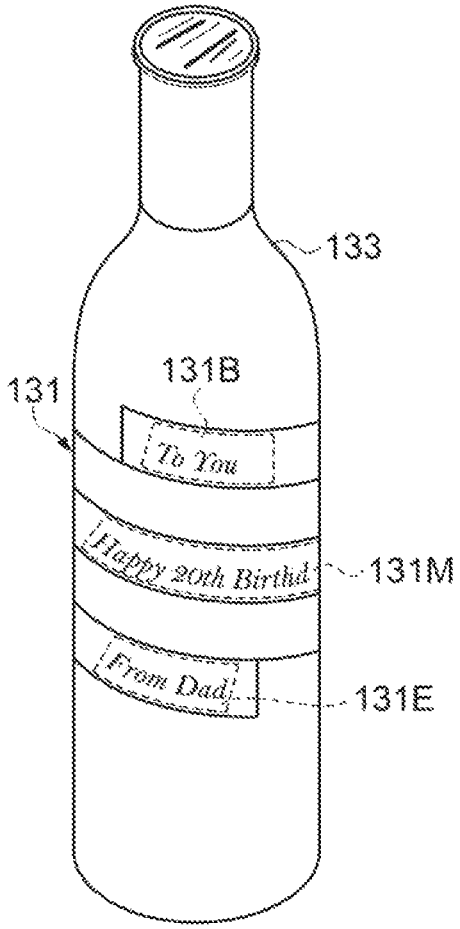
FIG. 17 is a view illustrating a use example of the printed product according to Example 4.

FIG. 16 is a view illustrating an image of a printed product according to Example 4. FIG. 17 is a view illustrating a use example of the printed product according to Example 4.

A ribbon 131 is a label wound around an article made in a shape of a tube, such as a bottle, and is a label on which the character rows are printed at a plurality of locations. The ribbon tape R in the example does not include the adhesive layer on the rear surface of the printing surface (front surface) which is an aluminum tape, and sticks to the article to be easily attachable to and detachable from by using curling of the aluminum tape or adhesiveness to the article by static electricity.

The ribbon 131 is a printed product created by sending the printing data generated as the printing data generation portion 11 of the host apparatus 1 is realized to the printing apparatus 2, and by printing and transporting the printing data to the ribbon tape R by the printing portion 22 of the printing apparatus 2 and the transport portion 25 based on the printing data.

The ribbon 131 includes three character regions 131B, 131M, and 131E, and two winding regions 131NP on the printing surface of the ribbon tape R.

"To You" is printed at a tip end of the ribbon 131 of the character region 131B, "Happy 20th Birthday" is printed at the center of the character region 131M, and "From Dad" is printed at a final end of the character region 131E. The winding region 131NP is disposed between the character region 131B and the character region 131M and between the character region 131M and the character region 131E. The character regions 131B, 131M, and 131E respectively have the length Lp. Furthermore, the lengths of the character regions are respectively described as the length Lp, but the lengths Lp may be the same length or may be different lengths.

The winding region 131NP has the length Lnp. Furthermore, regarding the winding regions 131NP at two locations, the lengths of each of the character regions is also described as the length Lnp, but, the lengths Lnp of each of the regions may be the same length or may be different lengths. However, the length Lnp of each of the winding regions 131NP is the length by which at least N or more (N is an integer that satisfies N≥3) pieces of continuous unit printing data exist. For example, when the unit printing data has the length for one character, the winding region 131NP has the length (practically the length having a corresponding amount for winding around the bottle) for at least three or more characters.

In the use example illustrated in FIG. 17, the ribbon 131 is wound around a trunk portion of a wine bottle 133. In a state where the ribbon 131 is wound around the wine bottle 133, the character region 131B is disposed on the first winding surface, the character region 131M is disposed on the third winding surface, and the character region 131E is disposed on one side (for example, front surface side) of the wine bottle 133 on the fifth winding surface. Therefore, the character rows at three locations, such as "To You", "Happy 20th Birthday", and "From Dad", are disposed on the front surface side of the wine bottle 133.

In the ribbon 131, by employing the above-described embodiment, it is possible to transport the regions of the character regions 131B, 131M, and 131E at the transport speed at which the printing quality can be ensured by performing the constant speed control, and to transport the regions of the winding regions 131NP at two locations at a high speed by raising the transport speed to the highest speed. Therefore, it is possible to further shorten the printing time compared to the related art, and to create the ribbon 131 of which the printing quality is ensured at the printing part as the printed product.

[Printed Product Generating Method]

Figure 18:
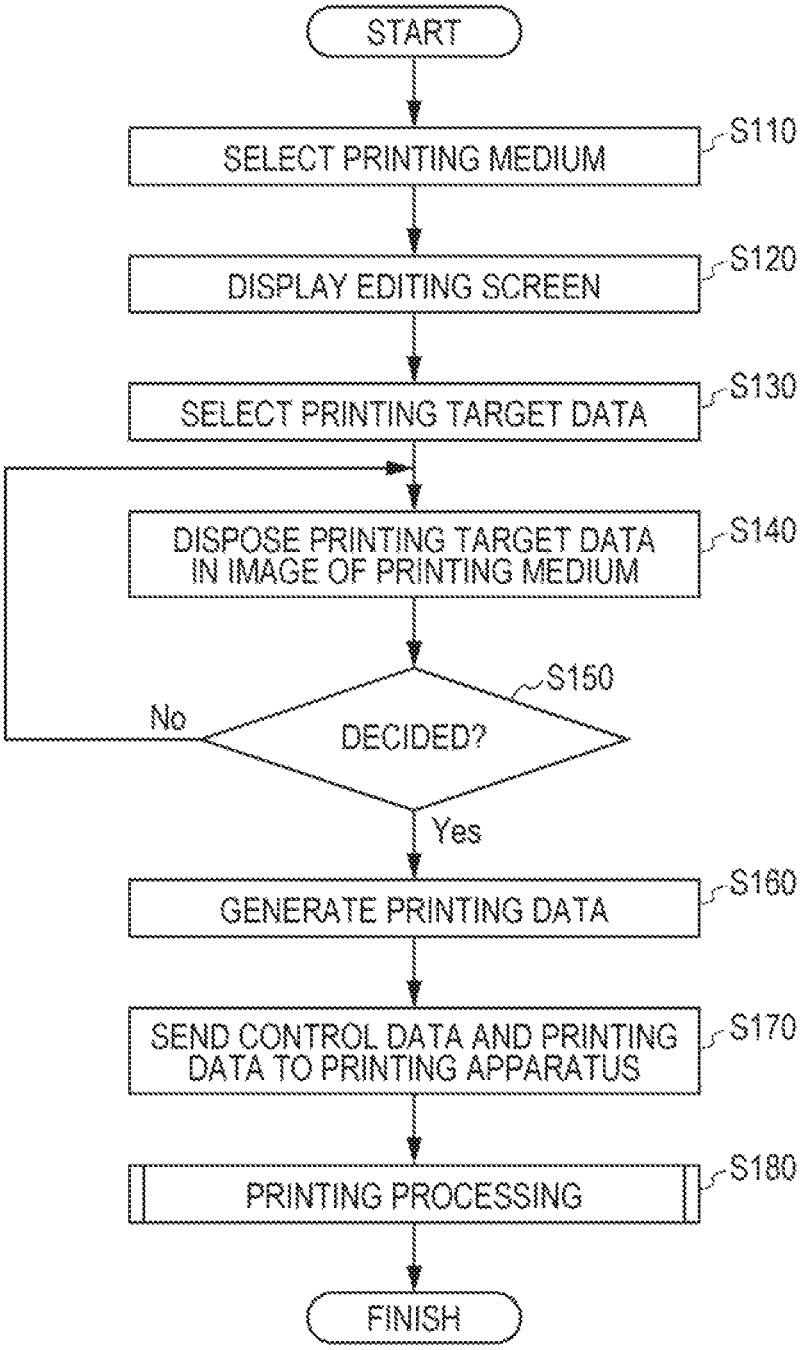
FIG. 18 is a flowchart illustrating a flow of printed product generation processing.

FIG. 18 is a flowchart illustrating a flow of printed product generation processing. The flow illustrated in steps S110 to S170 of the flowchart is a flow processed by realizing the function of the printing data generation portion 11 as the label creating application of the host apparatus 1 is executed by the CPU. Furthermore, the flow illustrating the flowchart corresponds to the printed product generating method.

In step S110, the printing medium is selected. Specifically, the type of the printing medium is obtained via the display portion and the operation portion of the host apparatus 1. For example, in a case where the label 101 is created in the example, the printing tape T is obtained, and in a case where the ribbon 121 is created, the ribbon tape R is obtained as the type of the printing medium.

In step S120, an editing screen is displayed. Specifically, an image of the printing medium is displayed in the display portion (host apparatus 1), and the editing screen which can designate the printing target data to be printed is displayed.

In step S130, the printing target data is selected. Specifically, characters, character rows, signals, and various images which are printed on the printing medium are obtained via the operation portion (host apparatus 1).

In step S140, the printing target data is disposed in the image of the printing medium. Specifically, the printing target data is disposed in the image of the printing medium on the editing screen by controlling the display portion and the operation portion. On the editing screen, information for guiding the disposition position is displayed in the image of the printing medium. For example, in the label 101, the length Lnp of the winding region 101NP is calculated from the diameter dimension of the TV cable 103, and the positions of the character regions 101F and 101B are calculated from the length Lnp and are displayed on the editing screen. In other examples, the position of each of the character regions can be calculated from the information, such as a diameter dimension and the number of printing characters of the gas pipe 113 in the label 111, the number of printing characters in the ribbon 121 and the size of the present 125, and a printing character row in the ribbon 131 and a diameter dimension of the wine bottle 133.

In step S150, it is determined whether or not the disposition position of the printing target data is decided. In a case where the disposition position is decided by the operation of the operation portion (YES), the process moves to step S160, and in a case where the disposition position is not decided (NO), the process returns to step S140.

In step S160, the printing data is generated. Specifically, the printing data including the printing target data and the non-printing region information is generated. The printing data having formats interpretable from each other by which the printing target data and the disposition position thereof which are decided in step S150 and the information of the non-printing region (length Lnp or the like), is generated between the host apparatus 1 and the printing apparatus 2. The formats interpretable from each other may be described in the printing command that corresponds to the printing apparatus 2 as described above, or may be described in a general-purpose language, such as a markup language. In addition, the format may be raster data rasterized based on the printing target data and the information of the non-printing region.

In step S170, the control data and the printing data are sent to the printing apparatus. Specifically, the control data including the information, such as the length L of the created label and the printing data generated in step S160 are sent to the printing apparatus 2.

In the printing apparatus 2, when the control data and the printing data are sent by the receiving portion 21, one or more pieces of unit printing data are generated by dividing the printing data by the CPU 41.

In step S180, the printing processing is performed. Specifically, the process moves to the flow illustrated in the flow (FIGS. 7 and 8) of the printing processing by the printing apparatus 2.

In this manner, the printing data is generated by steps S110 to S170 processed in the host apparatus 1. In addition, the printing data is sent to the printing apparatus 2, and by performing the printing or transport based on the printing data by step S180 processed in the printing apparatus 2, the printed product is output.

As described above, the printed product described in the above-described examples is generated by the printed product generating method. In the printed product, the non-printing region having a certain length which is used for winding or tying and the printing region (other printing regions) in which the characters or character rows are printed are included. In the printed product, the printing quality is maintained as the constant speed control is performed in the middle of processing of the printing region by the printing processing of step S180, and the printing time is shortened by the high-speed transport as the acceleration and deceleration control is performed in the middle of the processing of the non-printing region.

In addition, regardless of the above-described embodiment, the following modification examples can be employed.

Modification Example 1

Figure 19:
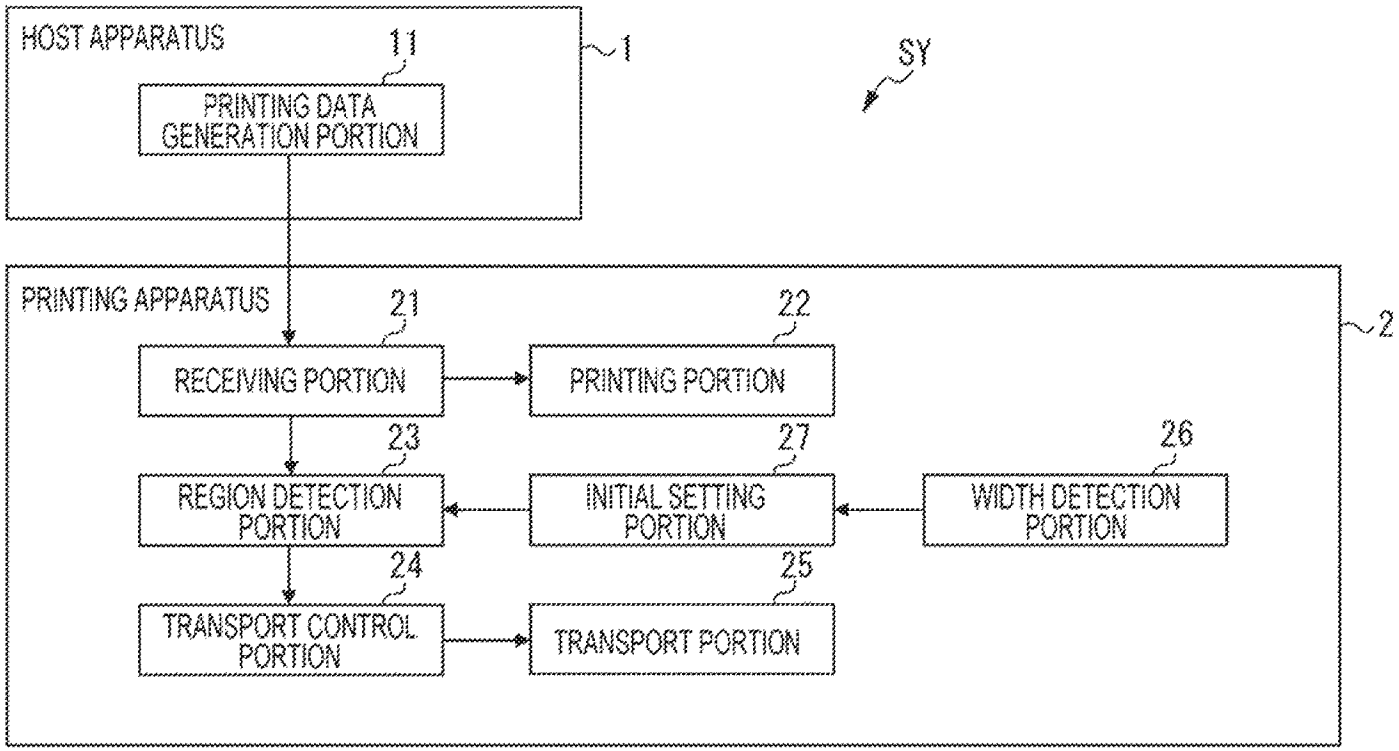
FIG. 19 is a block diagram illustrating a functional configuration of a printing system according to Modification Example 1.

In the above-described embodiment, the N value (threshold value when detecting the "non-printing region") is a fixed value, but may be a variable setting. FIG. 19 is a block diagram illustrating a functional configuration of the printing system SY according to Modification Example 1. The printing apparatus 2 of the modification example is configured by adding a width detection portion 26 and an initial setting portion 27 to the configuration (refer to FIG. 1) of the printing apparatus 2 of the above-described embodiment.

The width detection portion 26 detects the tape width (width in the direction orthogonal to the transport direction of the printing tape T) of the printing tape T accommodated in the printing apparatus 2. As a detecting method, a method of specifying the tape width by detecting a position or the number of projected portions or recessed portions formed in a tape cartridge that accommodates the printing tape T therein using a microswitch, a method of specifying the tape width by reading a code image (bar code or two-dimensional code) that is printed or sticks to the tape cartridge, or a method of measuring the tape width by an infrared sensor or the like, are considered. In addition, the initial setting portion 27 sets the N value in accordance with the detection result of the width detection portion 26. In other words, the "non-printing region" is detected in a case where N pieces of continuous non-printing data exist, but the N value which is the threshold value is set to be variable in accordance with the tape width of the printing tape T.

Figures 20, 21:
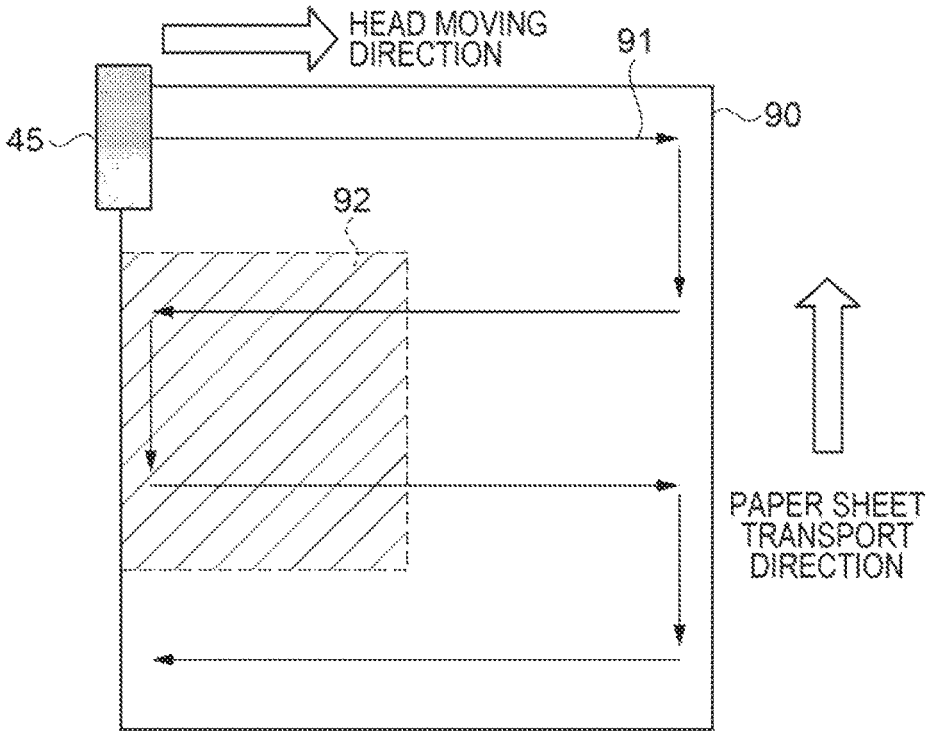
FIG. 20 is a view illustrating an example of a correspondence table illustrating correspondence of a tape width, a transport speed during the printing, and an N value according to Modification Example 1.
FIG. 21 is a view illustrating relative movement of a printing head according to Modification Example 2 and a paper sheet.

FIG. 20 is a view illustrating an example of a correspondence table illustrating correspondence of the tape width, the speed V1 (transport speed during the printing), and the N value according to Modification Example 1. As illustrated in FIG. 20, the speed V1 generally decreases as the tape width increases. Therefore, when aiming for obtaining a constant effect of shortening the printing time by the acceleration and deceleration control, it is possible to reduce the N value in a case where the tape width is large compared to a case where the tape width is small. In Modification Example 1, since the N value is set to be variable in accordance with the printing width of the printing medium, it is possible to obtain a constant effect of shortening the printing time regardless of the printing width.

In addition, when the N value is set to be variable, an L1 value (threshold value when distinguishing the printing length in step S02 of FIG. 7) may be set to be variable. In addition, in a case of the printing apparatus having a specification in which the highest speed (speed V2 in the above-described embodiment) varies in accordance with the printing width of the printing medium, it is preferable to set the N value that corresponds to the printing width of the printing medium considering the highest speed.

Modification Example 2

In the above-described embodiment, the line type printing head which is fixedly provided as the printing head 45 is used, but a serial type printing head which performs the printing while scanning may be used. In addition, not only the printing medium is moved relatively to the printing head, but also the printing head may be moved relatively to the printing medium. FIG. 21 is a view illustrating relative movement of the printing head 45 according to Modification Example 2 and a paper sheet 90 (printing medium). A rightward direction in FIG. 21 indicates a moving direction (main scanning direction) of the printing head 45, and an upward direction in FIG. 21 indicates a transport direction (auxiliary scanning direction) of the paper sheet 90. In addition, a solid line arrow 91 indicates a track (printing track) of the relative movement between the printing head 45 and the printing medium. In this manner, in a case of using the serial type printing head 45, the non-printing region (region in which continuous unit printing data that does not include the printing dot data exist) is detected two-dimensionally. For example, as illustrated in FIG. 21, in a case where a region of a numeral reference 92 is detected as the non-printing region, the acceleration and deceleration control is performed at least at a part while the printing head 45 faces the non-printing region in the middle of the movement of the printing head 45 in the main scanning direction. In this manner, in a case of relatively moving the printing head with respect to the printing medium, it is also possible to obtain an effect similar to that of the above-described embodiment.

Modification Example 3

In addition, in the above-described embodiment, it is described that addition of the "front blank" and the "rear blank" may be omitted, but it is distinguished whether or not the initial unit printing data is the non-printing data, the acceleration control is performed in the middle of the processing of the initial unit printing data in a case where the initial unit printing data is the non-printing data, and the acceleration control may be performed in the middle of transport of the "front blank" by adding the "front blank" in a case where the initial unit printing data is not the non-printing data. Similarly, it is distinguished whether or not the final unit printing data is the non-printing data, the deceleration control is performed in the middle of the processing of the final unit printing data in a case where the final unit printing data is the non-printing data, and the deceleration control may be performed in the middle of transport of the "rear blank" by adding the "rear blank" in a case where the final unit printing data is not the non-printing data.

Modification Example 4

In addition, in the above-described embodiment, in a case of detecting the non-printing region when the printing length is equal to or greater than L1, a variable control of the transport speed is thoroughly performed, but the variable control of the transport speed may be prohibited in accordance with the contents of the printing data or the added information of the printing data. For example, in a case where the high-quality printing mode is designated on the host apparatus 1 side and the mode information is added to the printing data, or in a case where the information for designating a certain image printing to the printing data, the variable control of the transport speed may be prohibited.

Other Modification Examples

In addition, each of the configuration elements of the printing apparatus 2 illustrated in the above-described embodiment may be provided as a program. In addition, the program may be provided being stored in various recording mediums (CD-ROM or flash memory). In other words, a program for allowing the computer to function as each of the configuration elements of the printing apparatus 2, and the recording medium that stores the program, are also included in a scope of rights of the present invention.

In addition, in the above-described embodiment, the printing is performed by a thermal transfer method, but the printing type, such as an ink jet type or a dot impact type, does not matter. In addition to this, appropriate changes are possible within a range that does not depart from the idea of the present invention, and for example, a control of the printing apparatus 2 is performed by using a cloud computing technology.

REFERENCE SIGNS LIST

1 HOST APPARATUS
2 PRINTING APPARATUS
11 PRINTING DATA GENERATION PORTION
21 RECEIVING PORTION
22 PRINTING PORTION
23 REGION DETECTION PORTION
24 TRANSPORT CONTROL PORTION
25 TRANSPORT PORTION
26 WIDTH DETECTION PORTION
27 INITIAL SETTING PORTION
41 CPU
42 RING BUFFER
43 MEMORY DECODER
44 DATA CONVERSION PORTION
45 PRINTING HEAD
46 MOTOR DRIVER
47 TRANSPORT MOTOR
48 ENCODER
50 TRANSPORT PATH
90 PAPER SHEET
91 PRINTING TRACK
101, 111 LABEL
121, 131 RIBBON
SY PRINTING SYSTEM
T PRINTING TAPE

The invention claimed is:

1. A printing apparatus for performing printing by moving at least one of a printing medium and a printing head relative to the other, comprising:

a region detection portion configured to analyze printing data and to detect a non-printing region, which is a region that does not become a target of a printing operation by the printing head; and a printing speed control portion configured to control a printing speed when the non-printing region faces the printing head to be higher than a printing speed when a printing region, which is a region that becomes a target of a printing operation, faces the printing head, wherein the printing speed control portion is configured to control the at least one of the printing medium and the printing head to maintain a constant relative speed at all times during which the printing region faces the printing head.

2. The printing apparatus according to claim 1, further comprising:

a transport portion configured to transport the printing medium along a transport path that faces the printing head, wherein the region detection portion is configured to detect one or more sections in a transport direction of the printing medium as the non-printing region, and the printing speed control portion is a transport control portion configured to control a transport speed of the transport portion.

3. The printing apparatus according to claim 2, wherein:

the printing head is a line type printing head, and the region detection portion is configured to distinguish whether or not each piece of unit printing data obtained by dividing the printing data by each of plural lines of data is printing target data including printing dot data or non-printing data that does not include the printing dot data, respectively, and to detect a processing target region of a predetermined number of pieces of continuous non-printing data as the non-printing region in a case where the predetermined number or more of pieces of continuous non-printing data exist.

4. The printing apparatus according to claim 3, wherein:

the region detection portion is configured to detect the non-printing region in a case where N (here, N is an integer that satisfies $N \geq 3$) or more pieces of continuous non-printing data exist, and the transport control portion is configured to control the at least one of the printing medium and the printing head to accelerate while the first partial non-printing region passes through the printing head, and to control the at least one of the printing medium and the printing head to decelerate while the (M−1)-th and/or M-th partial non-printing region passes through the printing head, among M partial non-printing regions which are processing target regions of M pieces (here, M is an integer that satisfies M≥N) of non-printing data that constitute the non-printing region.

5. The printing apparatus according to claim 4, wherein the transport control portion is configured to control the at least one of the printing medium and the printing head to decelerate while the processing target region of the final unit printing data passes through the printing head in a case where the final unit printing data is the non-printing data among the plural pieces of unit printing data obtained by dividing the printing data.

6. The printing apparatus according to claim 5, wherein the transport control portion is configured to control the at least one of the printing medium and the printing head to accelerate before the processing target region of the printing data passes through the printing head.

7. The printing apparatus according to claim 4, further comprising:

a width detection portion configured to detect a width in a direction orthogonal to the transport direction of the printing medium; and an initial setting portion configured to set the N value in accordance with the detection result of the width detection portion.

8. The printing apparatus according to claim 4, further comprising:

a printing portion configured to print the printing target data in the printing region of the printing medium, wherein the transport portion is configured to transport the printing medium including the printing region and the non-printing region.

9. A printed product which is the printing medium including the printing region in which the printing target data is printed by the printing portion and the non-printing region transported by the transport portion, and which is output from the printing apparatus according to claim 8.

10. A printed product generating method for generating the printed product according to claim 9, the method comprising:

selecting the printing target data to be printed on the printing medium;

designating the position at which the printing target data is disposed on the printing medium and the size of the printing target data;

designating the non-printing region on the printing medium; and transporting the printing medium and printing the printing target data on the printing medium.

11. A printing speed control method of a printing apparatus that performs printing by moving at least one of a printing medium and a printing head relative to the other, the method comprising:

a region detection step comprising analyzing printing data and detecting a non-printing region, which is a region that does not become a target of a printing operation by the printing head; and a printing speed control step comprising controlling a printing speed when the non-printing region faces the printing head to be higher than a printing speed when a printing region, which is a region that becomes a target of a printing operation, faces the printing head, wherein the printing speed control step controls the at least one of the printing medium and the printing head to maintain a constant relative speed at all times during which the printing region faces the printing head.

* * * * *